US006206370B1

(12) United States Patent
Halliburton

(10) Patent No.: US 6,206,370 B1
(45) Date of Patent: Mar. 27, 2001

(54) VARIABLE JACKPOT AMUSEMENT GAME

(75) Inventor: Ronald D. Halliburton, Delray Beach, FL (US)

(73) Assignee: Benchmark Entertaiment, L.C., Hypoluxo, FL (US)

( * ) Notice: Subject to any disclaimer, the term of this patent is extended or adjusted under 35 U.S.C. 154(b) by 0 days.

(21) Appl. No.: 09/354,724

(22) Filed: Jul. 16, 1999

Related U.S. Application Data

(62) Division of application No. 09/064,145, filed on Apr. 22, 1998, now Pat. No. 5,967,515.
(60) Provisional application No. 60/052,999, filed on May 5, 1997.

(51) Int. Cl.[7] ..... A63B 71/00
(52) U.S. Cl. ..... 273/138.1; 273/138.2
(58) Field of Search ..... 273/138.1, 138 R, 273/138 A, 126 A

(56) References Cited

U.S. PATENT DOCUMENTS 4,043,406 * 8/1977 Wolf ..... 273/138 R
4,061,334 * 12/1977 Kanno ..... 273/126 A
4,662,636 * 5/1987 Crompton ..... 273/138 A
4,759,551 * 7/1988 Crompton ..... 273/355
5,176,380 * 1/1993 Evans et al. ..... 273/138 A
5,275,402 * 1/1994 Malavazos et al. ..... 273/138 A
5,622,366 * 4/1997 Inoue ..... 273/138.2

* cited by examiner

*Primary Examiner*—Jessica J. Harrison
*Assistant Examiner*—Dolores R. Collins
(74) *Attorney, Agent, or Firm*—Venable; Richard L. Aitken

(57) ABSTRACT

In a coin operated amusement game, a coin track is provided directing coins toward a plurality of target receptacles arranged to receive properly timed coins. Relative movement is provided between the target track and the receptacles. A properly timed coin inserted in the track will roll down the track, then travel through the air, and then land in and be retained in the target receptacle. Dump targets are provided wherein a properly timed coin will activate the dump target and cause the corresponding receptacle to be dumped and provide the player with an award corresponding to the number of coins dumped out of the receptacle.

10 Claims, 6 Drawing Sheets

VARIABLE JACKPOT AMUSEMENT GAME

CROSS REFERENCE TO RELATED APPLICATIONS

This application is a divisional application of application Ser. No. 09/064,145, filed Apr. 22, 1999 now U.S. Pat. No. 5,967,515. This application claims the benefit of provisional application Ser. No. 60/052,999, filed May 5, 1997.

SUMMARY OF THE INVENTION

The present invention involves gaming devices designed to reward the skill of the player. The games have a relatively simple design and are accordingly easy and inexpensive to manufacture and can be adapted to a number of commercial embodiments. In accordance with the invention, a coin is inserted into a coin track having an U-shaped structure to cause the coin to roll in the track. The word "coin" is used herein to mean a monetary coin such as a quarter or it may also mean a token. The track directs the coin toward target receptacles and relative motion is provided between the track and the target receptacles as the coin rolls in the coin track. The player records a win and receives a reward if the player times the insertion of a coin into the track to cause the coin to land in the target receptacle. In addition, a player can win a jackpot and receive an award corresponding to all the coins accumulated in a target receptacle if the player achieves a precise timing of the coin to cause the coin to hit a dump target for the target receptacle.

A slot or slots are provided for the reception of coins or tokens. Coins which are inserted into a slot are directed to a coin acceptor. If the coin is genuine, it is next directed to an inclined track.

In the first embodiment, the top of the coin track is pivotally attached under the exit of the coin acceptor. The opposite end of the track is suspended in air over the play area and can move in an arc which spans a series of target receptacles. The track is moved by a linkage to a rotating wheel or cam provided inside of the cabinet to provide relative movement between the coin track and target receptacles. In this embodiment, the targeted receptacles comprise a series of toy dump trucks each having a bed and a dump lever. A player can score either by landing a coin in the bed of the truck or score a jackpot by hitting the dump lever with a coin. When the dump lever is hit, the player receives an award corresponding to the number of coins in the truck bed.

In a second alternative embodiment, the target receptacles are open train cars or trams, which are positioned around the periphery of a horizontal turntable having a simulated train track extending around the periphery thereof and on which the train cars are positioned. The turntable is rotated to provide simulated motion of the train cars traveling around the track on the turntable. Supported above the rotating turntable is a coin receiving console and from which coin tracks extend downwardly toward the train cars. The console has a coin receiving slot on all four lateral sides thereof to provide four playing positions on each of four sides positioned around the rotating turntable. A coin receiver is provided for each coin slot and a coin track is provided for each coin slot extending down toward the rotating train cars. When a coin is inserted into the slot, the coin, if genuine, will be directed into the coin track which directs the coin out toward the rotating train cars. If the coin is inserted at the proper time, the coin will fall into one of the train cars and be recorded as a win. If the insertion of a coin is perfectly timed, the coin will land in a dump slot, one of which is positioned over each train car. A coin landing and remaining in the dump slot will actuate a switch to cause the train car to be dumped and will be scored as a jackpot for the player who causes the coin to land and remain in the dump slot. The player will then receive an award corresponding to the number of coins in the car.

In both of the above described embodiments, coins which do not land in the target vehicle, either a dump truck or a train car, fall into the coin pit and are detected as they fall into coin collector. A win is detected, represented by a coin landing in the target vehicle, by the system failing to detect a coin falling into the coin collector a predetermined time interval after insertion of the coin into the coin slot.

When the player records a win, he is awarded with tickets or, alternatively, he may be awarded to coins or tokens.

DETAILED DESCRIPTION

Figure 1:
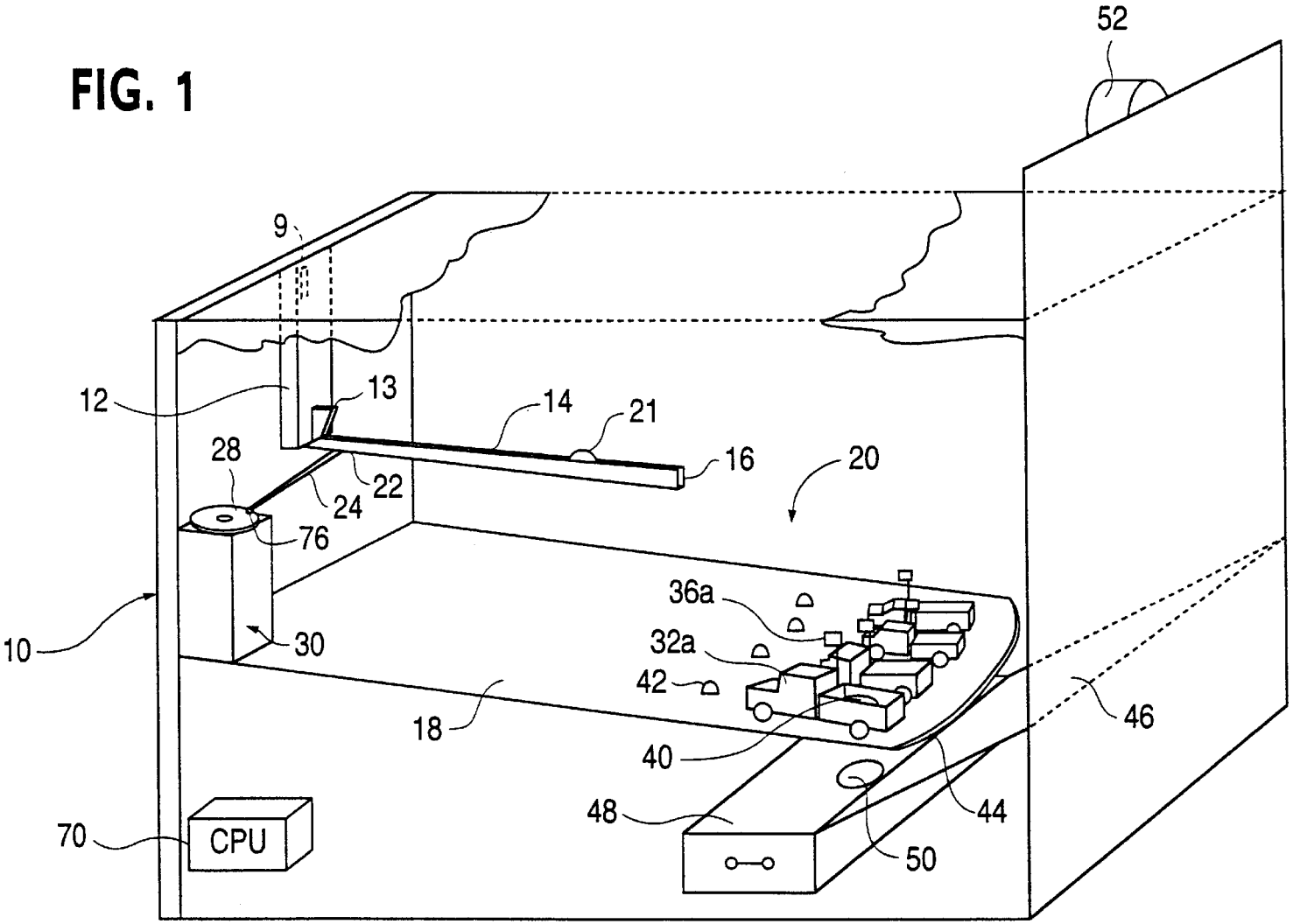
FIG. 1 is a perspective view partially broken away schematically illustrating a first embodiment of the coin operated amusement device of the invention.

As shown in FIG. 1, coins inserted into slot 9 on the front of cabinet 10, are received in a coin acceptor 12. Coin acceptors are commercially available devices designed to detect spurious coins or slugs and will allow genuine monetary coins or tokens to pass. Genuine coins pass through acceptor 12 and are ejected with a predetermined velocity onto a U-shaped track 14. Coins which do not conform to a predetermined criteria will be rejected and be returned to a dispenser area which can be accessed from the front of the cabinet. Track 14 is generally defined by a bottom and two vertical sidewalls which have a height approximately equal to the radius of the coin or token used. The vertical sidewalls are positioned apart from each other slightly wider than the width of the coin. The track is positioned on an incline with an elevated end directly below coin acceptor 12 and a lower distal end 16 suspended in space above the floor 18 of the play area. A coin such as that referenced by numeral 21 which is introduced to the top of the track will roll down the track and then will continue through the air in a path or trajectory determined by the location of the moving track. While the distal end of the track is free, the proximal end of the track is pivotally attached to the front of cabinet 10 directly beneath coin acceptor 12. The track 14 can thus generally move in an arcuate pattern within cabinet 10 and is supported by the pivot attachment. Lights may also be provided along the track which are actuated when a coin is inserted into the device.

Pivotally attached to track 14 is one end 22 of a crank or control arm 24 which horizontally extends from the track towards the side of cabinet 10. The opposite end 26 of control arm 24 is pivotally attached to the periphery of a wheel 28 or cam which is horizontally oriented on a bracket with respect to the play area. Wheel 28 is powered by a stepper motor 30. As the wheel rotates, the control arm sweeps the track back and fourth across the cabinet causing end 16 of the track to periodically align with the target receptacles. The motor 30 causes the wheel or cam 28 to rotate at a constant speed.

Beneath the elevated and inclined track 14 is an inclined panel which makes up the floor 18 of the play surface. Positioned on the floor are a series of toy dump trucks 32*a*–32*d* at locations outside the arc made by the end of the track. The trucks are positioned so that a coin which has rolled down the track 14 and gained momentum will fall downward and outward from the track as the track sweeps past the targets. If the drop of the coin is correctly timed, a coin leaving the end of the track will fall into the bed 40 of one of the trucks 32*a*–32*d* or hit one of the dump lever targets 36*a* through 36*d*. The beds of the trucks serve as targets in a preferred embodiment and can accumulate coins and tokens. The dump levers are secondary smaller targets, one which is provided for each larger target. The smaller targets serve as jackpot targets and function as a dump lever for the bed of the truck. If the dump lever target is hit by a coin or token, all the coins or tokens accumulated in the truck corresponding to the dump lever are dumped and credited to the player.

In front of each target receptacle is an indicator bonus light such as that designated by reference numeral 42. The bonus light is activated for a given target after a jackpot is scored. When the indicator bonus light is activated, the payoff for that target increases. The bonus indicator continues to flash at the truck until 15 coins or tokens have been detected as being accumulated in the bed on the truck. The bonus indicator thus provides an incentive to shoot at the empty target receptacles. In a preferred embodiment of the invention, after 15 coins have been detected in the truck bed of a previously emptied truck, the bonus light will change from truck to truck in a random fashion. In the preferred embodiment, the 100 tickets are provided for landing a coin in a target truck bed which has its bonus light activated.

Towards the rear of cabinet 10 the inclined floor 18 ends at a rear edge 44 which defines one side of a pit. A second surface 46 is inclined in the opposite direction and back under the floor 18. The second surface 46 directs the coins into a collection area 48 underneath the inclined panel defining the floor 18. Coins which do not land within one of the truck beds will fall onto the inclined surface of the floor 18 and their momentum will cause them to fall off the rear edge 44. Coins are then directed through a coin detector 50 and then to the coin collection area 48 which is not visible to the player.

In operation, a player can visually inspect the progress of the end 16 of the track 14 sweeping back and forth across the target trucks beds and target dump levers. The activation of the bonus lights 42 in front of the trucks further provides incentives to shoot at the targets. A player then attempts to time the insertion of a coin or token into the slot to cause the coins to roll off the distal end 16 of the track into the bed of a truck or to hit a jackpot target.

Figure 2:
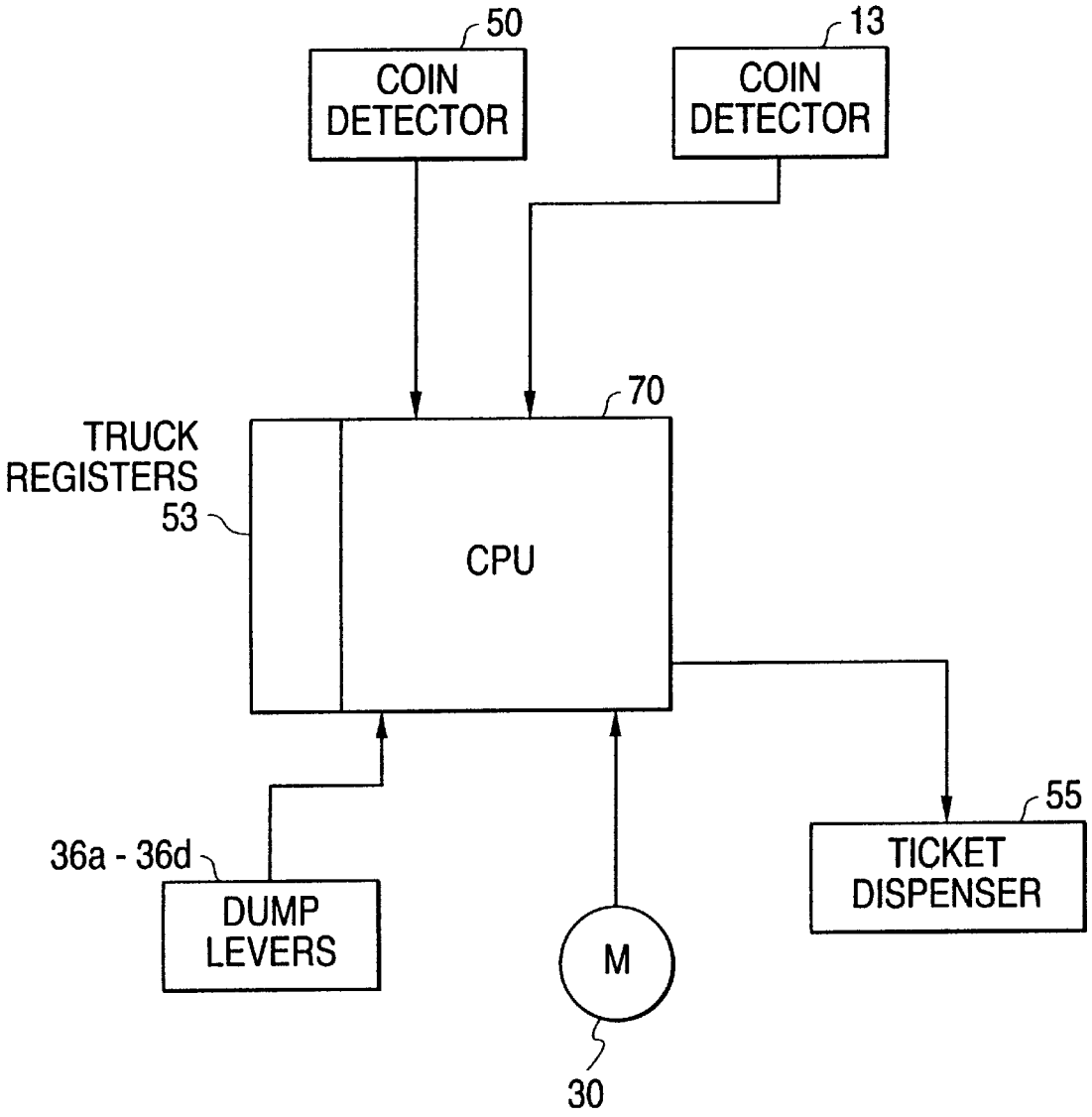
FIG. 2 is a block diagram of the circuit employed in the system of FIG. 1.

Thus, from the slot, genuine coins pass through the coin acceptor 12 and are directed to the inclined track. A signal is generated by detector 13 when a genuine coin is ejected from the coin acceptor 12 to track 14. As shown in FIG. 2, the signal from detector 13 is transmitted to a central processing unit 70. The coin then rolls down the track, off the end of the track and into the air, continuing to roll or turn through the air. Depending on the location of the end of the track, the coin will then either miss all targets, land in the bed of the truck or hit the dump lever target.

If the coin lands in the bed of the truck, the coin detector 50 located adjacent to the collection box does not detect a coin. If the coin detector 50 does not detect a coin within a predetermined time following detection of a coin by detector 13, the CPU 70 credits a score to the player. The target to which the score is allocated is based upon the location of the track 14 when the score is credited. In this regard, the position of the stepper motor 30 is divided into a series of angular sectors each of which corresponds to one of the target receptacles provided on the playing surface. A position sensor on the stepper motor provides a continuous input to the CPU 70 as shown in FIG. 2 to signal the CPU which angular sector the motor is in.

The detection of a hit into a truck bed proceeds as follows: after a coin is inserted, a signal is generated by coin detector 13 and if this signal is not negated after a predetermined time 20 by a signal from coin detector 50, the coin is credited to the target or truck bed 40 which corresponds to the current location of the distal end of the coin track 14. The CPU 70 has four registers 53, one for each of the trucks. Each register 53 keeps track of the number of coins in a corresponding truck bed. The CPU 70 determines the truck to which the coin is credited from the signal received from the position sensor on the stepper motor 30 indicating the angular sector of stepper motor and thereby indicating which truck bed 40 the distal end of the track 14 is adjacent. The CPU then increments the count in the register 53 corresponding to the truck 32*a*, 32*b*, 32*c* or 32*d* which is credited with receiving the coin or token.

After a signal from detector 13 has been as registered as a win, the CPU 70 then signals a ticket dispenser 55 to dispense a predetermined amount of tickets depending on the bonus status of the target. In a preferred embodiment, the dispenser will provide 100 tickets when the bonus indicator is activated and 10 tickets during routine play.

If a coin fails to land in a truck bed and fails to exit the device through the rear exit, no signal is generated by detector 50 to negate the signal generated from detector 13. In this circumstance, the play is recorded as a score corresponding to the sector of the play area that the distal end 16 of the track 14 was located. Accordingly, in the unlikely event a coin does not land in a truck bed, but, nevertheless, for some reason remains on the surface of the play area, the coin will be recorded as a score even though it does not land within the bed of the truck.

Figure 3:
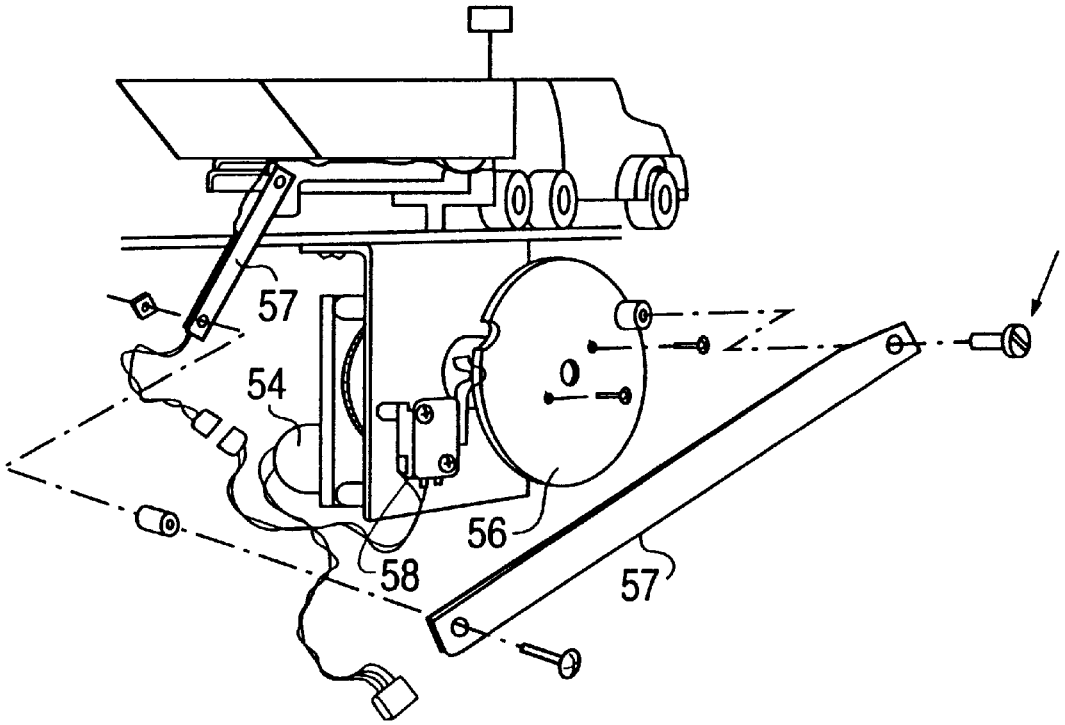
FIG. 3 illustrates an exploded view of the mechanism for dumping a target receptacle in the embodiment of FIG. 1.

When one of the dump levers 36*a*–36*d* is hit by a coin, a different sequence of events is initiated. The dump lever actuates a switch which sends a signal to the CPU 70 which then activates the light 52 and sound effects indicating a jackpot has been hit. The switch actuated by the dump lever also closes a circuit to energize a motor 54 corresponding to the dump lever the motor 54 being located under floor 18. As shown in FIG. 3, the motor 54 drives a cam wheel 56 through a reduction gear. The cam wheel 56 is connected to the truck bed 40 by means of a linkage 57. When the motor 54 is energized, it drives the cam wheel 56 to move the linkage 57 to lower the rear of the bed causing any coins which have accumulated within the truck to be dumped out the rear of the truck and over the edge 44 of the play area and into the pit. After the coins are dumped out of the truck bed, the motor 54 continues to run until the bed is returned to the down position. The motor 54 is stopped by the opening of the switch 58 by the cam wheel 56.

When a jackpot has been hit, the CPU 70 reads the number stored in the register 53 for the truck bed corresponding to the dump lever target. The CPU 70 then sends a signal to the ticket dispenser 55 to dispense a number of tickets which is proportional to the number of coins in the bed of the truck at the time the dump lever target for the truck was hit. The CPU 70 then resets the register to zero for the truck bed which paid off the jackpot. After the payoff, the CPU 70 activates the bonus light located in front of the target. The bonus light in front of the truck will remain activated until a predetermined number of coins are detected in the target. In a preferred embodiment, the bonus light remains activated until 15 coins are deposited within the truck bed. When the bonus light is activated, landing a coin within a truck will provide a bonus payoff as described above.

One feature of the invention involves the use of two types of targets, the first being a target receptacle which can accumulate coins and the second being a dump target which can score a jackpot. If a coin is received within target receptacle, a predetermined payoff is provided. The truck bed thus serves as a collection reservoir which can be visually inspected by a prospective player and this collection reservoir and serves as the jackpot which is dumped from the truck when a jackpot is scored. Thus, the payoff for the jackpot will be a variable number of tickets which will correlate with the number of coins in the truck bed. A second feature of the invention involves the unique manner in which the winning coins are recorded and properly accounted for their respective target truck bed. Yet, a further feature of the invention involves the incorporation of the bonus light which provides an incentive to fill a target receptacle after a jackpot has been achieved. Yet, a further feature of the invention is the novel moving track and stationary target arrangement of the game.

In the embodiment of the game shown in FIG. 1, toy trucks and dump levers are used as targets. It is contemplated that other types of vehicles and targets can also be used as exemplified by the embodiment shown in FIGS. 4–6.

Figure 4:
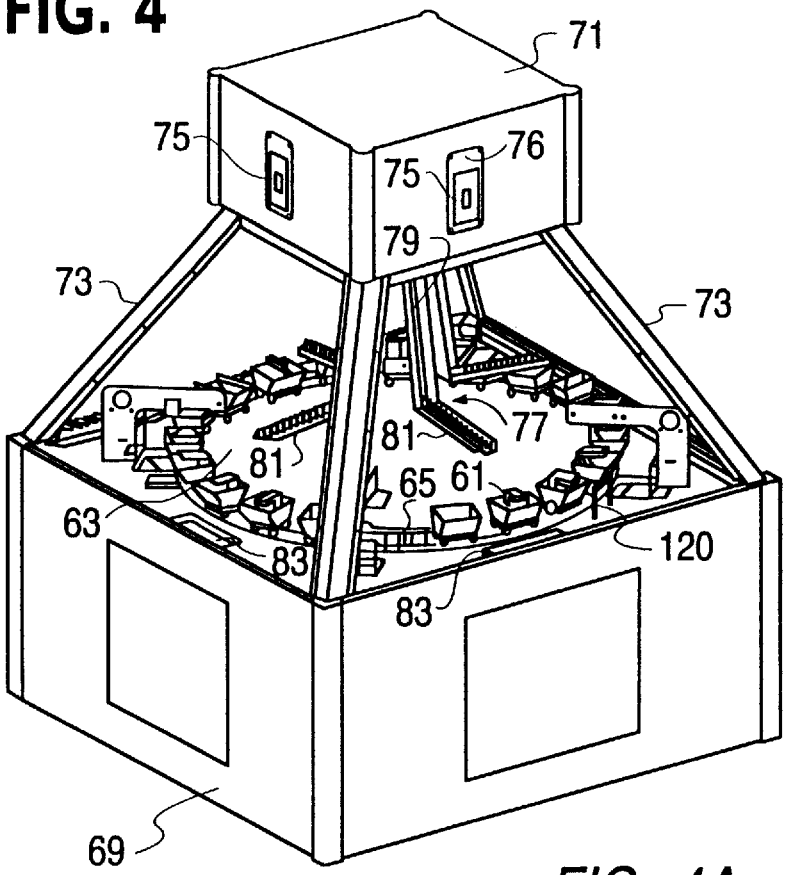
FIG. 4 is a perspective view schematically illustrating the second embodiment of the coin operated amusement game of the invention.
Figure 4A:
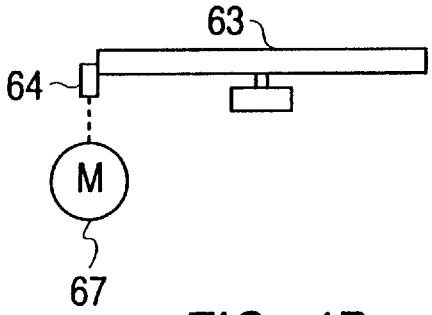
FIG. 4*a* schematically illustrates the turntable drive embodiment of FIG. 4.
Figure 4B:
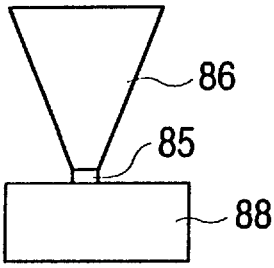
FIG. 4*b* schematically illustrates the structure for collecting and detecting coins that fall into the coin pit after missing a train car in the embodiment of FIG. 4.

In the second embodiment of the invention shown in FIG. 4, a series of train cars 61 are positioned on a horizontal turntable 63 distributed around its periphery on a simulated track 65 extending around the periphery. When the turntable rotates, it carries the cars in a circular movement as if they were moving on the track 65. The turntable 63 as shown in FIG. 4*a* is driven by a capstan 64 rotated by a motor 67 mounted in the cabinet 69, at the top of which the turntable 63 is rotatably supported in a suitable bearing. A console 71 is supported on four diagonal legs 73 extending from the corners of the upper surface of the cabinet 69. The console 71 is in the shape of a box having four vertical sides facing in four directions and in each of the four vertical sides, a coin slot 75 is provided arranged to receive coins from four different players positioned on the four different sides of the cabinet 69. Each of the coin slots 75 is defined by a coin acceptor 76, which is mounted in the console 71 and which is like the coin acceptor 12 employed in the first embodiment. If the inserted coin is determined to be genuine, then the coin acceptor ejects the coin into a coin track 77 through a coin detector 78 like the coin detector 13 of the embodiment of FIG. 1 (see FIG. 5). The coin detector 78 determines that the coin has been accepted and has been inserted into a corresponding coin track. There are four coin tracks 77, one each to receive a coin from a different coin slot 75 and, thus, each to receive a coin from a different one of the players. The upper part 79 of each of the tracks 77 is mostly vertical, but is inclined slightly outward so that the inserted coin will fall very fast, but remain in the coin track 77. The lower part 81 of the coin track extends radially outward toward the track 65 and the rotating cars 61 and it is inclined downwardly at a slight angle so that the coins will roll by the force of gravity radially outward on the lower part 81 of the coin track. The end of the lower part 81 of each coin track is positioned a short distance inside the locus of the rotating cars 61 so that a coin inserted into a coin track 77 and then rolling out from the end of the lower part 81 of a coin track 77 will fall in a trajectory into a car 61 if the car is positioned opposite the lower part 81 of the track when the coin rolls out of the end of the track. Thus, if a coin is properly timed, it will fall into one of the cars 61. If the coin is not properly timed, the momentum of the coin will carry it outwardly to fall through an opening 83 in the top surface of the cabinet 69 to be collected in a coin collector within the cabinet 69. The embodiment shown in FIG. 4 includes coin detectors to detect any coins passing through the opening 83 similar to the operation of the coin detector 50 in the embodiment of FIGS. 1 and 2. As shown in FIG. 4*b*, a coin chute 86 in the cabinet 69 guides the coins falling through opening 83 to the coin collection box 88. A coin detector 85 is positioned to detect the coin as it passes from the chute 86 into the coin collection box 88.

Figure 5:
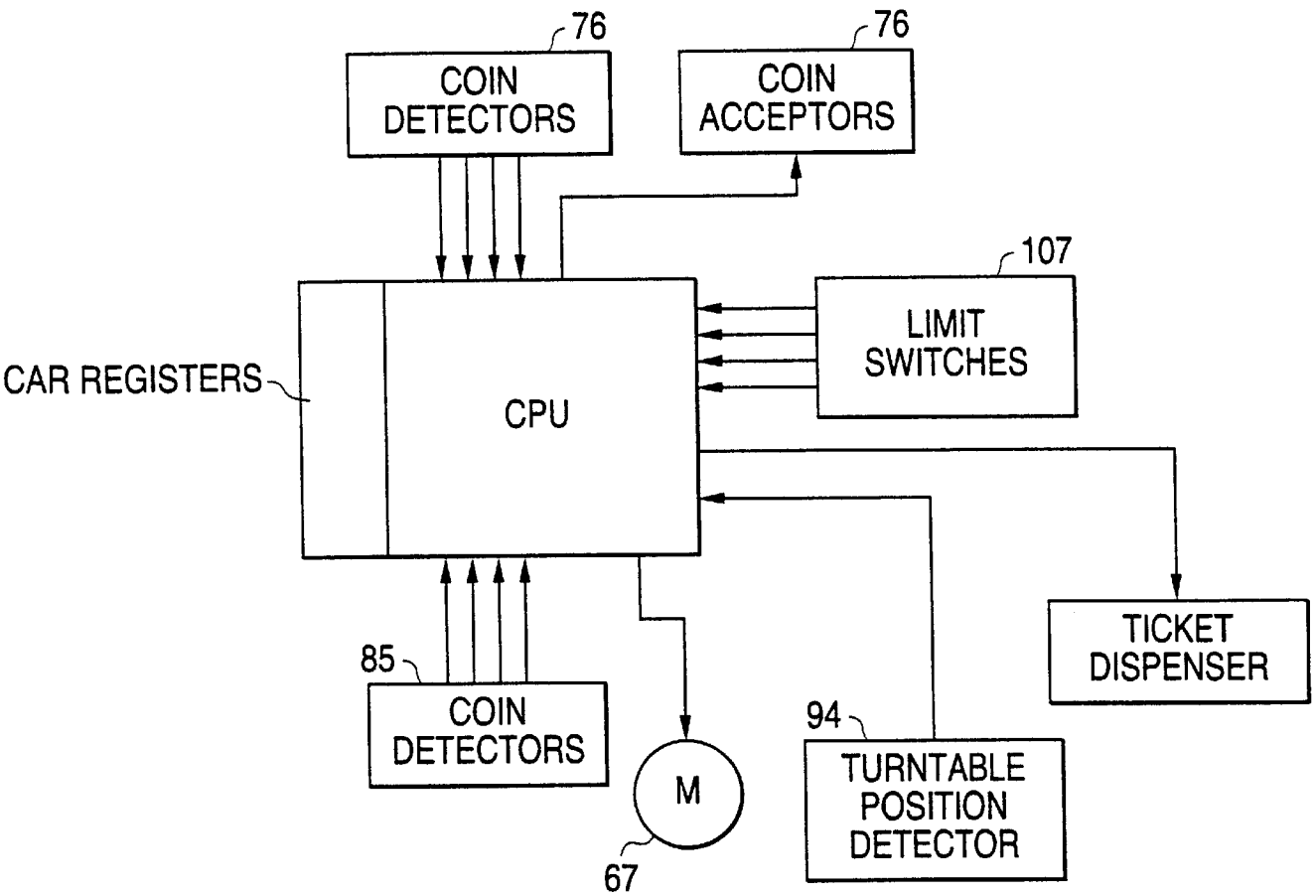
FIG. 5 is a block diagram of the circuit employed in the amusement game of FIG. 4.

As shown in the block diagram of FIG. 5, a coin detector 78 detects the insertion of a coin into a coin track 77 and applies this signal to a CPU 87. Since there are four player positions, there are four coin detectors 78, one for each track 77 and four coin detectors 85, one for each opening 83. If, after a coin is inserted into a slot 75, as detected by a coin detector 78, and no corresponding signal is detected by the corresponding coin detector 85 after a predetermined time interval sufficient for the coin to have reached the coin detector 85, then it is presumed that the coin landed in a train car 61 and it is recorded as a score. Thus, the embodiment of FIG. 4 detects a coin landing in the target receptacle in the same indirect manner as the embodiment of FIG. 1, that is, by the absence of a signal from a coin detector detecting coins which miss the target receptacles.

Figure 6:
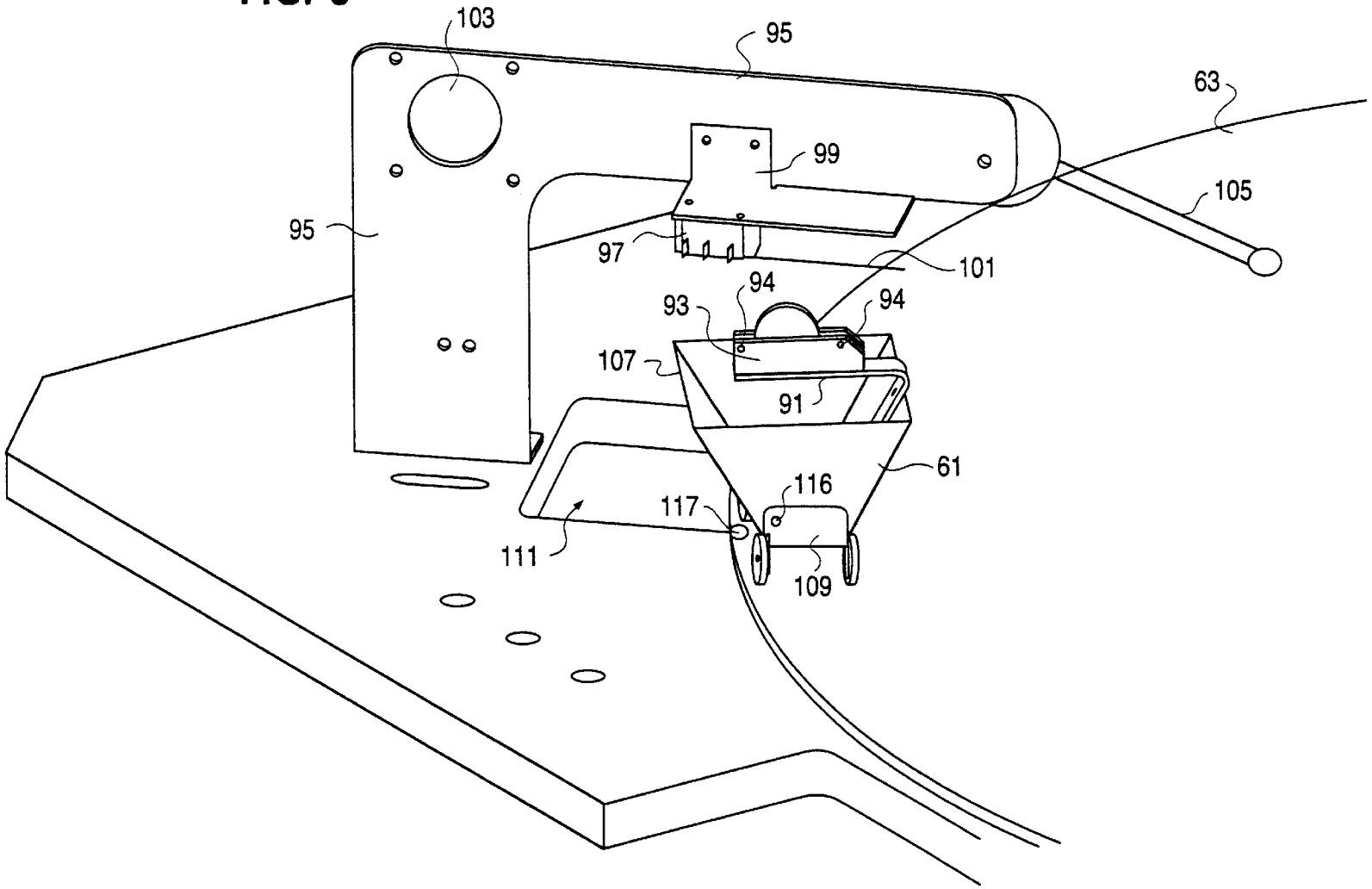
FIG. 6 is a partial perspective view showing the details of the target receptacle of the embodiment of FIG. 4 and the mechanism for dumping the target receptacle.

As best shown in FIG. 6, each of the train cars 61 has an arm 91 cantilevered from the radial inward side of the car 61 extending over the middle of the open top of the car and mounted on the arm 91 is a slot former 93 defining a dump slot having an upwardly facing mouth sized to receive one of the coins or tokens. If a coin is perfectly timed for a given car, upon arriving at the coin the car will fall into and be retained in the dump slot formed in the slot former 93. The dump slot has a width a little wider than a coin so as to hold the coin upright and has a depth equal to about one-half of the width of a coin or token for which the amusement device is designed. The dump slot is formed between two parallel rigid panels connected by pins 94 at each end of the dump slot to retain the coins in the dump slot once they have been received.

Adjacent to each corner of the cabinet on the top surface thereof, an L-shaped support 95 having an upper horizontal arm extending over the periphery of the turntable 63. A coin detector in the form of a limit switch 97 is mounted on the horizontal arm of each L-shaped support 95 by means of a bracket 99. The switch 97 has an actuating arm 101 extending horizontally radially inward and positioned to be engaged by a coin held in a dump slot of a slot former 93. When a coin has landed and retained in a dump slot, the coin will them be carried by the corresponding train car 61 under the horizontal arm of an L-shaped support 95 where the coin held in the dump slot will engage the actuating arm 101 of the limit switch 97. When the limit switch 97 is actuated, it will signal the CPU 87 which will stop the motor 67. By the time the motor 67 stops the travel of the turntable 63, the car 61 will have moved a little past the dump position opposite the L-shaped support 95. The CPU then energizes the motor 67 in the reverse direction to move the car which holds the coin in the dump slot back to the dump position directly under the horizontal arm of the L-shaped support 95. The CPU will energize a motor 103 mounted in the L-shaped support 95 to actuate a dump arm 105. The motor 103 will pivot the dump arm in a clockwise direction as shown in FIG. 6 to engage the inner side of the car 61 positioned in the dump position. A receptacle 107 comprising a portion of the train car 61 is pivotally mounted on the lower carriage 109 of the train car to pivot on an axle 116 and when the receptacle 107 is engaged by the arm 105, it will be tipped to pivot about the axle 116 to dump the coins in the receptacle 107 into the dump chute 111 located between the periphery of the wheel 63 and the vertical arm of the L-shaped support 95. The CPU 87 will keep track of the number of coins deposited in each train car 61 by means of registers, one for each of the train cars in the same manner as in the embodiment of FIGS. 1 and 2. A turntable position sensor 96 senses the position of the turntable and provides a signal to CPU 87 to indicate the position of the turntable. From this position information, the CPU 87 determines which train car 61 is credited with receiving a coin, when a coin is detected as landing in train car by the failure of a coin detector 85 to detect the passage of a coin after the corresponding coin detector 78 detects the insertion of a coin into a track 77. The CPU 87 then increments the register corresponding to the train car credited with receiving a coin. When a train car is dumped to dump its coins out into a dump chute, the CPU 87 will reset the corresponding register to zero and actuate the ticket dispenser 113 to award a number of tickets proportional to the number of coins in the car that has been dumped. Alternatively, in an embodiment providing a coin or token payoff, the coins dumped out of the car can be dispensed to the player directly.

While a coin is being dumped, the CPU 87 will lock the coin acceptors 76 so that coin cannot be inserted in the slots 75 while dumping process is being carried out. After the dumping process has been completed, the CPU 87 energizes the motor 67 to again drive the turntable in the clockwise direction and unlocks the coin acceptor.

Wire cams 120 are mounted on the top of the cabinet 69 adjacent to the periphery of the turntable 63 between the dump positions and the score positions opposite the distal end of the tracks 77. The wire cams 120 are positioned to engage a tipped car 61 and as a tipped car is moved by the rotation of the turntable, it comes into engagement with a wire cam 120 which cams the tipped car 61 back into upright position as the tipped car moves in engagement with the wire cam 120.

The target receptacles in the embodiment of FIGS. 4–6 are provided with bonus lights like the embodiment of FIGS. 1–3. A bonus light 117 is provided on the wheel 63 between each train car 61 and the periphery of the wheel. When a train car has been recently dumped, the bonus light will be lit indicating that a player will win a bonus payoff if the player lands a coin or token in the train car marked by an illuminated bonus light. When a car has been dumped, the CPU 87 lights the corresponding bonus light and maintains the bonus lit until a predetermined number of coins have been determined to have landed in the car marked by the bonus light. While the bonus light remains lit, the payoff for landing a coin in the car marked by the bonus light is substantially increased by the CPU 87 to encourage players to try to land coins in cars which have been recently dumped.

The four player arrangement of the above-described embodiment provides a high degree of excitement to the players since the players can win coins or awards from a train car containing coins which have been fed by another player.

It will be noted that both of the above-identified embodiments use the indirect method of detecting the coins which have landed in the bed both for purposes of determining an award and determining the number of coins which have been accumulated in a target receptacle. As described above, the indirect method involves detecting the occurrence of a coin having landed in the bed by the absence of a coin being detected by the coin detector detecting coins which miss the target receptacle.

The above described specific embodiment employs rolling coins as projectiles. The machine could be modified to accommodate other rolling projectile such as marbles. Other modifications may be made to the above described specific embodiment of the invention without departing from the spirit and scope of the invention.

What is claimed is:

1. An amusement game comprising a target receptacle, a slot arranged to receive and retain a coin in an upright position adjacent to said target receptacle, a target moving mechanism arranged to move said target receptacle and said slot along a predetermined path, a coin detector positioned to be actuated by a coin retained in said slot as said slot moves through said path, and a dump mechanism activated in response to actuation of said coin detector and operable when activated to dump coins retained in said target receptacle out of said target receptacle.

2. An amusement game as recited in claim 1, wherein said game includes a plurality of target receptacles and a plurality of slots each capable of receiving and retaining a coin in an upright position adjacent to a corresponding target receptacle, said target moving mechanism arranged to move each said target receptacles and said slots along said predetermined path, said coin detector being positioned to be activated by a coin being retained by one of said slots, said dump mechanism being operable to dump the coins from the target receptacle adjacent to the slot retaining the coin that actuated said coin detector.

3. An amusement game as recited in claim 1, further comprising means to define a plurality of player positions distributed along said path, means at each of said player positions to direct a coin at said receptacle and at said slot as they pass by such player position.

4. An amusement game as recited in claim 1, wherein said path comprises a circular path, said target moving mechanism moving said receptacles and said slot repeatedly through said circular path.

5. An amusement game as recited in claim 1 wherein said dump mechanism tips said target receptacle to a tipped position to dump coins out of said receptacle, said amusement device further comprising a cam positioned to engage a receptacle in a tipped position as receptacle moves in said path, and arranged to cam said receptacle into an upright position by the movement of said receptacle in engagement with said cam.

6. An amusement game comprising a target receptacle, a dump target arranged to receive and retain a projectile in a predetermined position adjacent to said target receptacle, a target moving mechanism arranged to move said target receptacle and said dump target along a predetermined path, a projectile detector positioned to be actuated by a projectile retained in said dump target as said dump target moves through said path, and a dump mechanism activated in response to actuation of said projectile detector and operable when activated to dump projectiles retained in said target receptacle out of said target receptacle.

7. An amusement game as recited in claim 6, wherein said game includes a plurality of target receptacles and a plurality of dump targets each adjacent to a corresponding target receptacle and each capable of receiving and retaining a projectile in an predetermined position, said target moving mechanism arranged to move said target receptacles and said dump targets along said predetermined path, said projectile detector being positioned to be actuated by a projectile being retained by one of said dump targets, said dump mechanism being operable to dump the projectiles from the target receptacle adjacent to the dump target retaining the projectile which actuated said projectile detector.

8. An amusement game as recited in claim 6, further comprising means to define a plurality of player positions distributed along said path, means at each of said player positions to direct a projectile at said moving receptacle and said moving dump target they pass by such player position.

9. An amusement game as recited in claim 6, wherein said path comprises a circular path, said target moving mechanism moving said receptacle and said dump target repeatedly through said circular path.

10. An amusement game as recited in claim 6, wherein said dump mechanism tips said target receptacle to a tipped position to dump projectiles out of said receptacle, said amusement device further comprising a cam positioned to engage a tipped receptacle as said tippled receptacle moves in said path and arranged to cam said receptacle into an upright position by the movement of said receptacle in engagement with said cam.

* * * * *